US005158103A

United States Patent [19]

Leu

[11] Patent Number: 5,158,103

[45] Date of Patent: Oct. 27, 1992

[54] TIRE ANCHORED POLE SUPPORT SYSTEM

[76] Inventor: James M. Leu, 159 Thornhurst, Bolingbrook, Ill. 60439

[21] Appl. No.: 560,561

[22] Filed: Jul. 30, 1990

[51] Int. Cl.[5] ..... E04H 15/06

[52] U.S. Cl. ..... 135/88; 135/95; 135/114; 135/116

[58] Field of Search ..... 135/88, 87, 95, 101, 135/114, 116; 52/63, 83

[56] References Cited

U.S. PATENT DOCUMENTS

| | | | |
|---|---|---|---|
| 2,480,509 | 8/1949 | Ripley | 135/88 |
| 2,798,501 | 7/1957 | Oliver | 135/88 X |
| 2,989,967 | 6/1961 | Lee | 135/88 |
| 3,036,583 | 5/1962 | Miller | 135/88 X |
| 3,940,099 | 2/1976 | McCleskey | 135/88 X |
| 4,655,236 | 4/1987 | Dorame et al. | 135/88 |

FOREIGN PATENT DOCUMENTS

| | | | |
|---|---|---|---|
| 0875992 | 8/1961 | United Kingdom | 135/88 |

*Primary Examiner*—David A. Scherbel
*Assistant Examiner*—Lan Mai
*Attorney, Agent, or Firm*—Hill, Van Santen, Steadman & Simpson

[57] ABSTRACT

A column base assembly for erecting temporary column structures, a base assembly held firmly in place by a vehicular tire resting thereon. The base assembly provides an easily erected column structure usable in a variety situations where a temporary structure can be erected near to a parked vehicle, such as signs, lights, sheds, tents or awnings. The base assembly provides a sturdy and stable column base erectable on hard surfaces, eliminating the need for staking.

25 Claims, 3 Drawing Sheets

TIRE ANCHORED POLE SUPPORT SYSTEM

BACKGROUND OF THE INVENTION

The invention relates to a base assembly for a column structure, particularly to an unanchored, simply-supported base assembly which is prevented from overturning by the weight of a vehicular tire pressing down upon a base plate of the base assembly, pressing the base plate against the ground or other datum.

The invention is particularly adapted for temporary support columns which would remain securely in place as long as the vehicle, which provides the tire which holds the base plate down, is stationary at the site. Typical uses for such a base assembly would be for columns holding signage or awnings adjacent to an automobile at an automobile show; for supporting a banner or display on a column adjacent an automobile at an automobile sale lot; for supporting a shelter over a boat residing on a trailer, the trailer providing the tires which hold down the base assembly which supports the columns of the structure, or for erecting a temporary shelter, such as a tent, adjacent to, or over, a vehicle.

Temporary columns for displaying signage or holding awnings or canopies usually require that the column base plates be staked or otherwise anchored into the ground. Also, guy-wires directed from the top of the columns to adjacent areas where they are staked into the ground are sometimes used. These type of anchoring systems are more difficult to use, especially where the ground is an asphalt or concrete surface where stakes can not be easily driven. The present invention provides a base assembly which requires no penetrations of such hard surfaces.

SUMMARY OF THE INVENTION

The present invention provides for an easily manufactured and field assembled column structure adjacent to a vehicle.

Objects of the present invention are:

- to provide an inexpensive and effective base assembly for securely erecting temporary columns;
- to provide a base assembly which requires no staking into the ground to prevent overturning;
- to provide a base assembly which can be broken down into small lightweight components which can be loaded into a small volume such as the trunk of an automobile;
- to provide a convenient assembly for a table to hold tools or other articles adjacent to a vehicle;
- to provide a convenient base assembly for erecting a tent adjacent to a vehicle;
- to provide a convenient base assembly for erecting temporary signage on a hard surface area such as a parking lot;
- to provide a convenient base assembly for erecting a canopy or awning arrangement over, or adjacent to, a vehicle;
- to provide a convenient base assembly to hold a column adjacent to a vehicle, the column holding signage, lights, or loud speaker accessories; and
- to provide a convenient base assembly for erecting a column an adjustable distance away from a cooperating vehicle tire.

The objects are inventively achieved in that a base assembly is provided which:

- comprises a lightweight assembly easily manufactured and assembled, featuring a base plate and a vertical receiving tube attached to the base plate, the base plate laying flat on the ground with the vehicular tire resting on top of the base plate, the receiving tube thereupon upright for receiving a column therein with a set screw for locking the column inside the receiving tube;
- comprises in one embodiment a table top which has an inverted receiving tube attached to a bottom of the table top and oriented downward, for receiving a top of the column therein, the table top providing a table surface for setting tools, or other articles, thereon for convenience while a user or mechanic is working on a car or performing other activities near to a vehicle;
- provides a secure base assembly for erecting tents or awnings adjacent to a vehicle, where tent or canopy columns can be installed at each wheel on one side of a vehicle, forming columns from which the tent or awning can be erected outwardly, thus a tent or awning can be erected quickly and easily with a minimum amount of staking, which is beneficial in hard ground areas or rocky areas;
- provides an easy method to install a temporary canopy structure over a vehicle wherein four such base assemblies can be utilized, one at each tire of a four tired vehicle, allowing for four upright columns from which can be constructed a box shaped canopy enclosure for the vehicle residing therein;
- comprises in one embodiment, lugs and rings mounted to the base plate for attaching knee braces and guy-wires to laterally support tall columns;
- comprises in a second embodiment, a base plate held beneath a vehicle tire and a separate satellite base holding a column, the satellite base held in place by telescoping arms projecting from the base plate onto the satellite base, and the column reinforced against overturning by guy-wires from the column down to the arms.

Other objects and advantages of the present invention will become apparent upon reference to the accompanying description when taken in conjunction with the following drawings.

DESCRIPTION OF THE PREFERRED EMBODIMENT

Figure 1:
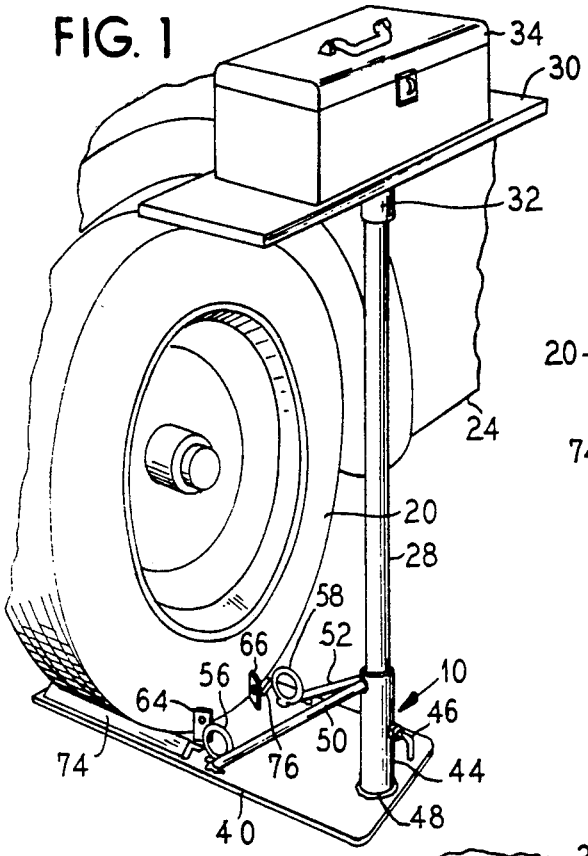
FIG. 1 is a perspective view of the base assembly holding a column holding a table top adjacent to a vehicle.

FIG. 1 shows a base assembly 10 held firmly to the ground by a tire 20, itself connected to a vehicle 24. The base assembly 10 holds a column 28 at its lower end, the column 28 holding a table top 30 via a coupling 32. The coupling 32 is connected to the table top 30, such as by welding (not shown). The table top 30 can hold a variety of articles such as a tool box 34.

The table top 30 provides a convenient and secure location for placing tools while a mechanic is working under the hood of an automobile, or a convenient and secure location for any articles which by their nature are used adjacent to a vehicle. The table top 30 can in fact be a duplicate of the base assembly 10 but installed in an inverted orientation. Thus, manufacturing a separate table top is eliminated with resulting cost savings with regard to duplication of parts. A user can purchase two base assemblies 10 and use them for erecting two columns (as described in detail below) or use the respective second one inverted as a table top 30 as shown in FIG. 1.

The base assembly 10 comprises a base plate 40, a substantially flat plate, whereupon is connected a receiving tube 44 which holds a set screw 46. The receiving tube 44 is connected to the base plate 40, such as by welding at 48, or by any other known means. The receiving tube 44 is laterally supported by a first diagonal brace 50 and a second diagonal brace 52 which connect a top portion of the receiving tube 44 with the base plate 40. Also provided attached to the base plate 40 are receiving rings 56, 58 to be used for receiving guy-wires such as in the embodiment discussed later with respect to FIG. 4. A first lug 64 and a second lug 66 are also provided, attached to the base plate 40, for providing an attachment location for knee braces 88*a*, 88*b* also discussed with respect to FIG. 4. The base plate further provides a first tire guide 74 and a second tire guide 76 which help the vehicle driver roll the tire 20 onto the base plate in the proper location initially, and thereafter help in preventing slippage of the base plate 40 from beneath the tire 20. The first "bump" or feel tells the driver the tire 20 has passed onto the plate, and the second "bump" or feel from the second tire guide 76 tells the driver he is progressing too far, and off the base plate 40.

Figure 2:
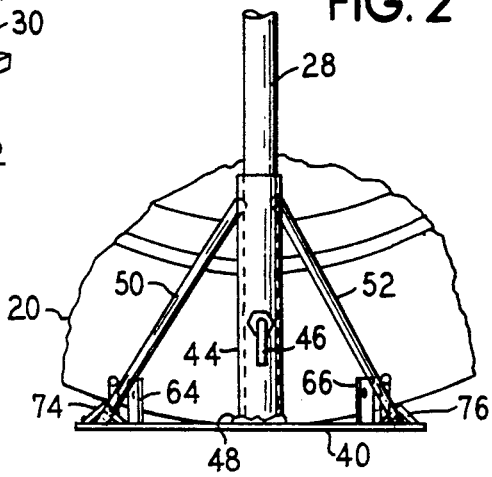
FIG. 2 is a right-side view of the base assembly of FIG. 1.

FIG. 2 shows the same elements as described with respect to FIG. 1.

Figure 3:
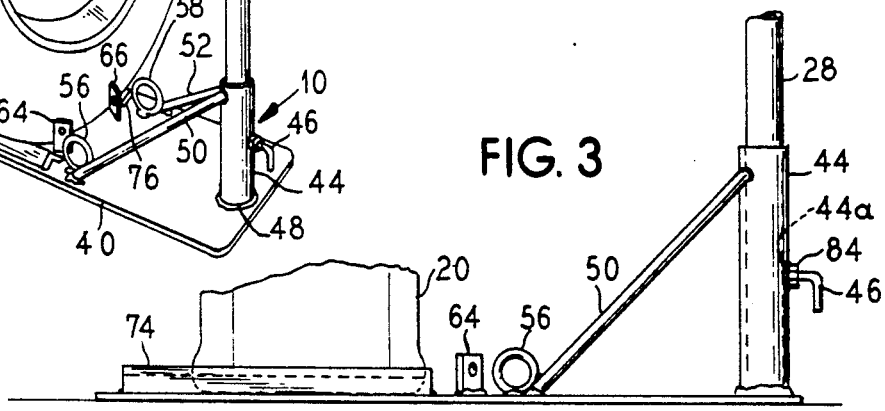
FIG. 3 is a front-view of the base assembly of FIG. 1.

FIG. 3 shows the same elements as described in FIG. 1, however the set screw is shown in more detail. The set screw 46 comprises a L-shaped screw member threadingly received inside a nut 84, the nut 84 welded to an outside of the receiving tube 44. By projecting the set screw 46 through the nut and through an aligned hole 44*a* through the receiving tube 44, and thereby abutting a forward end of the set screw 46 against the column 28, the column 28 is locked inside the receiving tube 44.

Figure 4:
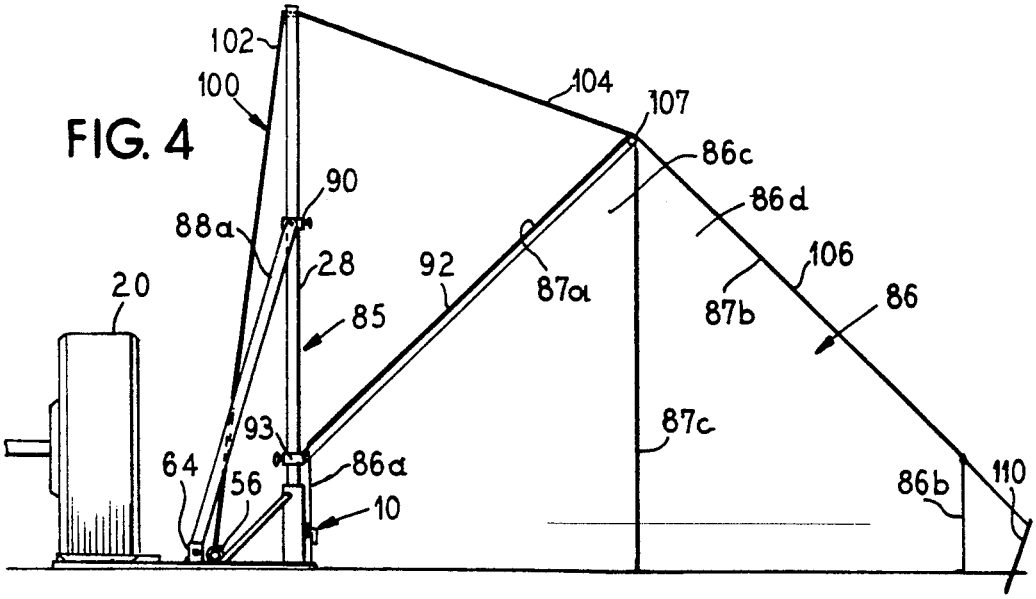
FIG. 4 is a front elevational view of a column structure using the base assembly of FIG. 1.

FIG. 4 shows another application of the invention. In this application, the base assembly 10 is also utilized with a column 28, and is held firmly in place by a tire 20. However, a pair of knee braces 88*a*, 88*b* (88*b* shown in FIG. 8) are utilized in a column structure 85. The knee braces 88*a*, 88*b* are attached to the column 28 at a clamp 90 and are attached at the base plate 40 at lugs 64, 66. The two knee braces 88*a*, 88*b* and the column 28 received inside the receiving tube 44 of the base assembly 10 form the column structure 85 having a tripod-arrangement which prevents tipping of the pole with respect to the horizontal plane.

The arrangement of FIG. 4 is shown utilized in conjunction with a tent 86. The tent shown is a typical military shaped tent having short sides 86*a*, 86*b*, front flaps 86*c*, 86*d*, sloping roof panels 87*a*, 87*b*, as well as a back portion not shown in this front elevational view. The back portion would typically be a solid fabric of a shape equivalent to the additive area of the two front flaps. The tent 86 is held upright by at least one guy-wire 100. The guy-wire is configured into a first segment 102, a second segment 104, and a third segment 106. The third segment 106 terminates at a stake 110 driven into the ground on a side of the tent 86 opposite the tire 20. The tent 86 comprises a horizontal beam 107 spanning from a front of the tent 86 to the back of the tent, and located in the corner formed by roof panels 87*a*, 87*b*. The tent 86 or column structure 85 provides a strut member 92 which connects the beam 107 with the column 28, using a strut clamp 93. Thus, at least one base assembly 10, at the tire 20 on the vehicle 24, in conjunction with a minimum amount of stakes, can effectively hold the tent erect. In the preferred embodiment the column structure 85 supports only a front end of the tent 86 with a duplicative column structure 85*a* supporting a rear end of the tent 86 (not shown). Additionally, duplicative guy-wire segments support the rear of the tent 86 in identical fashion with that shown in FIG. 4. The strut 92 would hold up a front end of the beam 107 and a duplicative strut 92*a* would hold up a rear end of the beam 107. Likewise, a second guy-wire 100*a* could be utilized on the duplicative column structure 85*a* to hold the beam 107, and hold the tent erect to a duplicative stake 110*a*. It is also readily apparent that each column structure 85, 85*a* could utilize two guy-wires attached to each base assembly 10 in a spaced apart fashion to provide lateral resistance to column overturning at each base plate 40.

Figure 5:
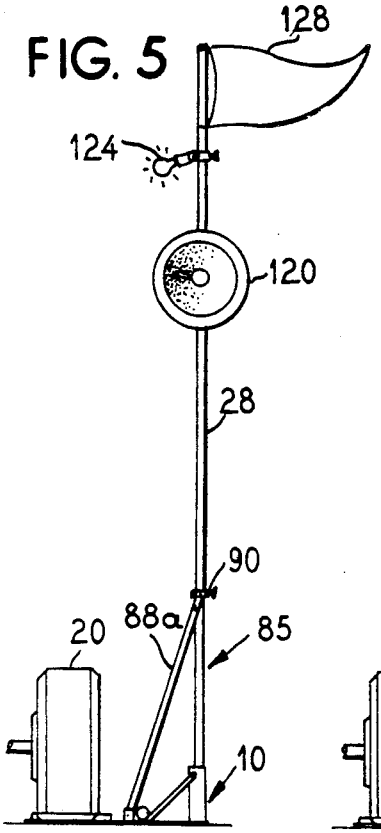
FIG. 5 shows an alternate use of column structure of FIG. 4.

FIG. 5 shows a second application of the base 10 and the column structure 85 wherein a single column structure can be utilized to hold accessories such as a loud speaker 120, a light 124 and/or a pennant 128.

Figure 6:
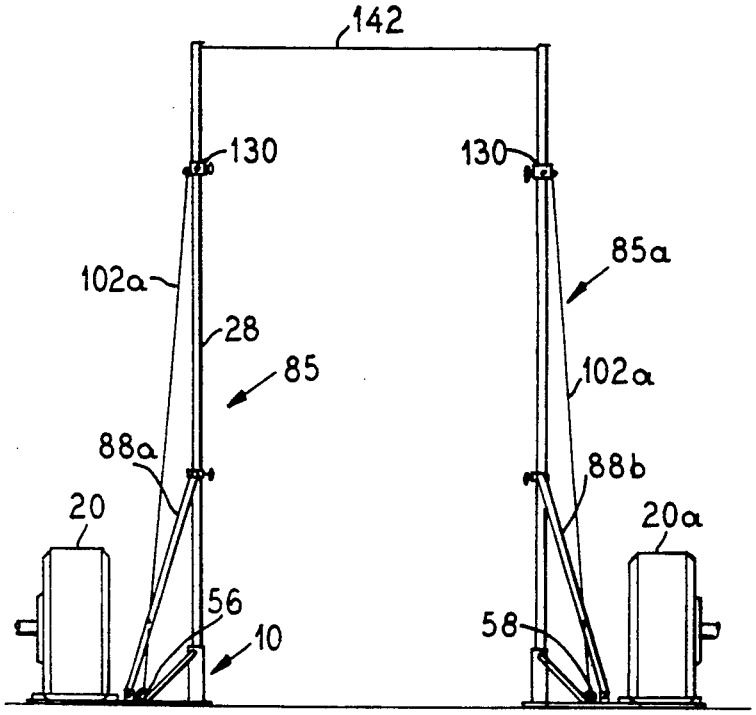
FIG. 6 is a front elevational view of a second alternate use of the column structure of FIG. 4 using two vehicles and two column structures.

FIG. 6 shows how two column structures 85, 85*a* engaged by two vehicle wheels 20, 20*a* can be utilized to hold a wire 142 between the two structures 85, 85*a*. The wire 142 could hold many items hanging therefrom, such as banners, signs, fencing, a volleyball net, etc. FIG. 6 shows that each column structure 85, 85*a* utilizes a diagonal guy-wire 102*a* spanning from a ring 56, 58 to a column clamp 130. As more clearly shown in FIG. 8, the use of two diagonal guy-wires 102*a*, 102*b* attached to spaced apart rings 56, 58 provides increased lateral overturning resistance. Column clamp 130 is a known type of collar clamp.

Figure 7:
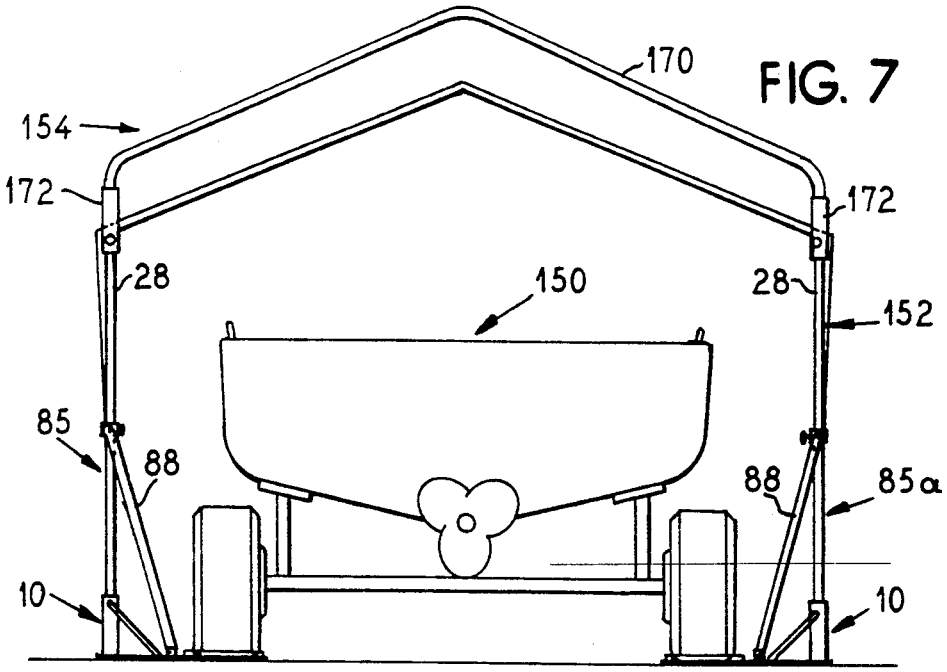
FIG. 7 is a front elevational view of a third alternate use of the column structure of FIG. 4 using at least two column structures, and using one vehicle.

FIG. 7 shows another application of the invention wherein two column structures 85, 85*a* utilizing base assemblies 10 at a rear end of a vehicle, in this arrangement a boat-holding trailer 150, form a rear structural bent 152 of a shed 154. At a front end of the arrangement, two additional base assemblies 10 could be utilized with corresponding column structures to form an identical structural bent 152*a* (not shown). Thus, four columns are erected, one at each wheel of the vehicle 150. Side structure can be added to tie the two bents 152, 152*a* together and provide rigidity to the skeleton of the shed 154. The four columns hold a roof structure 170 which provides weather protection for the vehicle. Additionally, sides can be attached around the outside of the shed 154. A lightweight canvas, plastic or other appropriate material would well suit the temporary nature of this structure.

Figure 8:
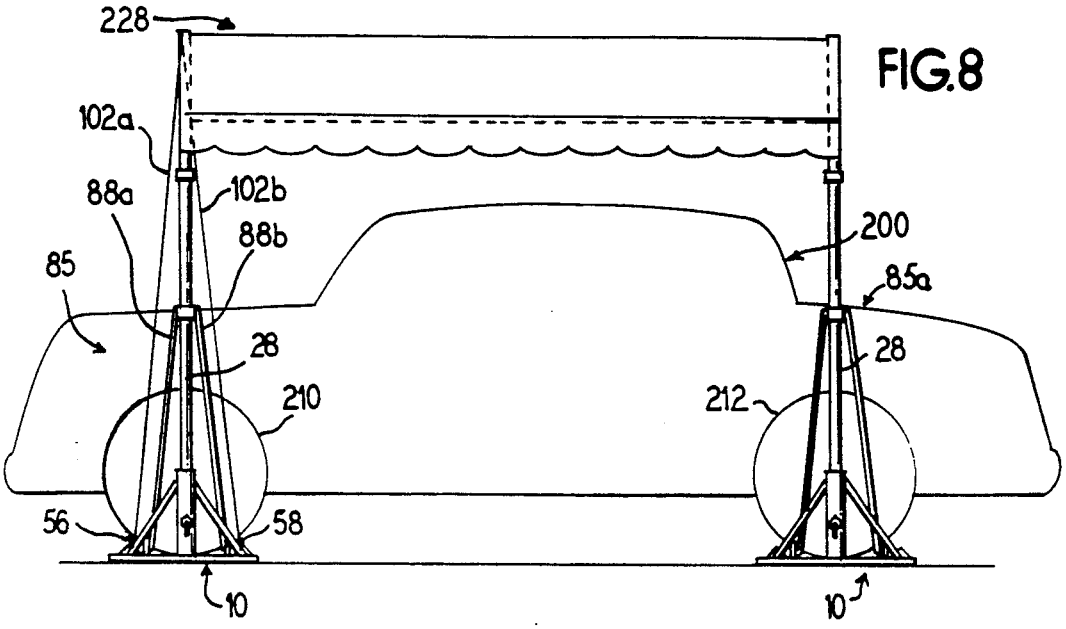
FIG. 8 is a side elevational view of a fourth alternate use of the column structure of FIG. 4 using two base assemblies and two column structures and one vehicle.
Figure 10:
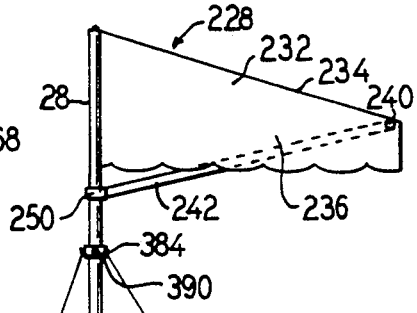
FIG. 10 is a front elevational view of the base assembly of FIG. 9, and further showing in detail the awning assembly of FIG. 8.

FIG. 8 shows another arrangement of the column structures 85, 85*a*. In this arrangement the column structures 85, 85*a* are utilized on the same side of an automobile, at each tire, to support the columns 28 which hold an awning 228 projecting away from the automobile 200. This arrangement can be utilized to provide a shady place to sit during various outdoor activities. The awning assembly is described further with respect to FIG. 10. The column structure 85 shows the use of the diagonal guy-wires 102*a*, 102*b* for column lateral stability.

Figure 9:
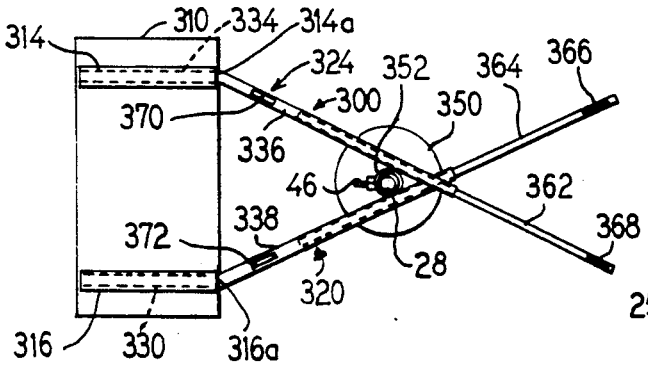
FIG. 9 is a top plan view of an alternate embodiment of the base assembly.

FIG. 9 shows an alternate embodiment of the base assembly referred to as the satellite base assembly 300. In this embodiment, the satellite base assembly comprises a base plate 310 whereon is mounted tubular guides 314, 316. The tubular guides 314, 316 can have a variety of cross sections, but are substantially hollow with open ends 314*a*, 316*a* respectively. The tubular guides 314, 316 act in a fashion similar to the guides 74, 76 but serve another function as well. The satellite base assembly 300 comprises telescoping arms 320, 324 which structurally tie the base plate 310 to a satellite plate 350. The satellite plate 350 is shown in this particular embodiment as a round plate, but other shapes could also work. The telescoping arms 320, 324 have offset base portions 330, 334 which insert into the guide tubes 314, 316 respectively through the open ends 314*a*, 316*a*. The telescoping arms 320, 324 project from the base plate 310 outward to the satellite plate 350 and beyond. The telescoping arms "crisscross", with one telescoping arm 324 resting on top of the respective other telescoping arm 320. Additionally, the telescoping arms have extension arms 362, 364 which can be extracted outwardly to increase the overall length of the telescoping arms. At one end of the telescoping arms 320, 324 are attached guy-wire rings 370, 372 and at a remote end of the extension arms are attached additional guy-wire rings 366, 368. As shown more clearly in FIG. 10, a plurality of guy-wires are utilized to stabilize the column 28 against overturning. The guy-wires 380*a* and 382*a* are shown connecting guy-wire ring 372 to a column clamp 384 attached to the column 28 by a second set screw 390. Also, a guy-wire 382*a* is shown attaching the guy-wire ring 368 to the column clamp 384. Likewise, a guy-wire would attach the guy-wire ring 370 and 366 to the clamp 384. Thus, four guy-wires are utilized to provide a column 28 greatly resistant to overturning.

Figure 11:
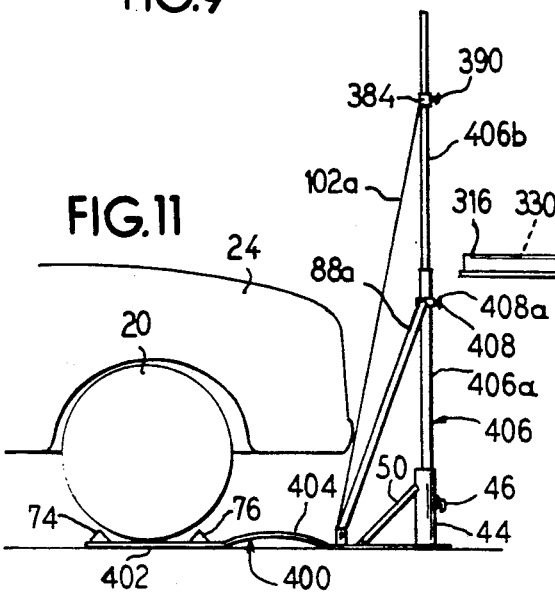
FIG. 11 is a front elevational view of a second embodiment of the base assembly.

FIG. 11 shows a second alternate embodiment 400 of the base assembly wherein an elongated base plate 402 is provided with increased length so that a column 406 can be located in the front of the vehicle 24 rather than to the side. The elongated base plate 402 includes a bridge section 404 which the inventor anticipates will accomplish two functions. The bridge section 404 should help to reduce stresses in the base plate 402 caused by a high overturning moment near the connection of the base plate 402 and the receiving tube 44, and also should provide some flexibility for adjusting for ground height differences between the location of the tire 20 and the location of the receiving tube 44. Uneven surfaces can be more easily accommodated due to the inherent flexibility of the arcuate bridge portion 404.

The second alternate embodiment 400 of the base assembly utilizes a majority of the same components as the base assembly 10. The receiving tube 44 with the set screw 46 are utilized. The diagonal braces 50, 52 are also utilized (brace 52 not shown in FIG. 11). The knee braces 88*a*, 88*b* can be utilized as well as the diagonal guy-wires 102*a*, 102*b* (knee brace 88*b* and diagonal guy-wire 102*b* shown in FIG. 8). An alternate column 406 is shown in FIG. 11. The alternate column 406 is a telescoping column made up of a first column segment 406*a* and a second column segment 406*b*. The first column segment 406*a* has a greater diameter than the second column segment 406*b*, wherein the second column segment 406*b* can be telescopically received within the first column segment 406*a*. A set-clamp 408 serves two functions. First, the set-clamp 408 anchors the two knee braces 88*a*, 88*b* to the column 406. Second, the set-clamp 408 has a third set screw 408*a* which is threadingly received by the set-clamp 408, penetrates through a hole provided in the wall of the first column segment 406*a* and abuts, or alternatively also penetrates, the second column segment 406*b*. Thus, the telescoping column assembly provides a quickly assembled column which can be disassembled into relatively small components for storage in, for example, an automobile trunk. The guy-wires 102*a*, 102*b* are secured to the second column segment 406*b* at the guy-wire clamp 384 which is secured to the column with a second set screw 390.

Figure 12:
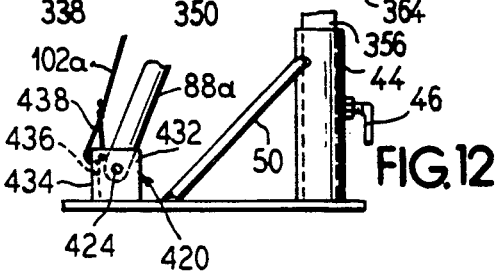
FIG. 12 is a front partial elevational view of a third alternate embodiment of the base assembly.

FIG. 12 shows an alternate detail to the ring and lug configuration of FIG. 1. Rather than using a ring 56 and a lug 64, those two elements are combined in a single angle lug 420 wherein a first face 432 holds the knee brace 88*a* at a connection 424, and a second leg 434 has an aperture 436 therethrough to hold a knot 438 from the guy-wire 102*a*. This results in a simplification of the base assembly.

The base assembly and included knee braces, struts and telescoping arms can be constructed of materials appropriate for the function. More heavy duty applications would require metals such as steel or aluminum, whereas other jobs can be accomplished using plastics or even wood.

Although the present invention has been described with reference to a specific embodiment, those of skill in the art will recognize that changes may be made thereto without departing from the scope and spirit of the invention as set forth in the appended claims.

I claim as my invention:

1. A base assembly for erecting a column comprising:

a base plate having a bottom surface for bearing upon a datum, and a top surface area for receiving a pressing weight of a vehicle through a tire mounted to said vehicle rolled onto said base plate;

a receiving means for holding upright said column, said receiving means attached to said base plate and providing structure for mounting said column;

a first diagonal brace attached at an upper end to said receiving means at a location elevated from said base plate, and attached at an opposite end to said base plate at a distance form said receiving means;

a second diagonal brace attachable at an upper end to said column elevated from said receiving means and attached at a lower end to said base plate at a distance from said receiving means.

2. A base assembly as claimed in claim 1, wherein said receiving means comprises an upright tube member having a bottom end attached to said base plate and having an open top end for receiving a bottom end portion of a column inserted therein.

3. A base assembly as claimed in claim 2, wherein said receiving tube further comprises a set screw, said set screw threadingly received by said receiving tube, said set screw projected into said receiving tube in a direction lateral to the axis of the receiving tube, said set screw abutting said column residing within said receiving tube, and locking said column within said receiving tube.

4. A base assembly as claimed in claim 2, wherein said base assembly further comprises a third diagonal brace, said third diagonal brace attached near said top end of said receiving tube and attached at an opposite end to said base plate.

5. A base assembly as claimed in claim 4, wherein said base assembly further comprises a fourth diagonal brace, said fourth diagonal brace arranged to be attachable at an upper end to said column elevated from said base plate and attached at an opposite end thereto to said base plate at a distance from said receiving means.

6. A base assembly as claimed in claim 1, wherein a column comprises a particular cross-sectional shape, and said receiving means comprises a receiving tube having an inside axial bore having the same particular cross-sectional shape as the column, only slightly larger, such that the column can be inserted at one end into said receiving tube, said receiving tube attached to said base plate at a bottom end and said tube open at a top end, said receiving tube oriented at a selected angle with respect to said top surface of said base plate.

7. A base assembly as claimed in claim 6, wherein said receiving tube comprises a hollow cylinder and said column has a circular cross section.

8. A base assembly as claimed in claim 1, wherein said base assembly further comprises at least one tire guide, said tire guide attached to said base plate at said top surface area, said tire guide providing a raised structure, communicating a bump sensation to a driver of the vehicle, with regard to the location of the tire on the base plate.

9. A base assembly as claimed in claim 8, wherein said base assembly comprises two tire guides, a first tire guide communicating to the driver, the start of engagement of the tire with said top surface area, the second tire guide communicating the termination of the engagement with the top surface area, when the tire is rolled upon and along the top surface area of the base plate.

10. A base assembly as claimed in claim 1, wherein said first diagonal brace and said second diagonal brace comprise cross sections with sufficient moments of inertia to resist both tension and compression forces.

11. A temporary column structure comprising:

a base plate;

a receiving tube mounted to said base plate, and having an open end facing upwardly;

at least one diagonal brace connecting said base plate and said receiving tube near said open end of said receiving tube;

at least one lug mounted to said base plate at a distance from said receiving tube;

a column, inserted into said open end of said receiving tube and held therein erect;

at least one knee brace connecting said lug to said column at an elevation above said receiving tube;

and said base plate provides a open top surface area providing access to a vehicular tire to be rolled thereupon, said vehicular tire mounted to a vehicle, said vehicle causing a pressing weight through said vehicular tire onto said base plate to hold said base plate firmly to a surface.

12. A column structure as claimed in claim 11, wherein said base plate provides tire guides to give sensory feel to a driver of said vehicle that his tire is properly located on said base plate.

13. A column structure as claimed in claim 11, wherein said diagonal brace comprises two diagonal braces forming a tripod arrangement with said receiving tube, and said knee brace comprises two knee braces forming a second tripod arrangement with said column.

14. A column structure according to claim 11, wherein said base plate further comprises at least one anchor ring, said anchor ring secured to said base plate at a distance from said receiving tube, and said column structure further comprises a guy-wire, said guy-wire attached to said anchor ring at a first end and attached to said column at a second end, providing increased resistance to overturning of the column, with respect to at least one axis.

15. A base assembly as claimed in claim 11, wherein said at least one diagonal brace comprises two diagonal braces arranged angularly spaced apart about an axis of said receiving tube, and said at least one lug comprises two lugs, and said at least one knee brace comprises two knee braces arranged angularly spaced apart about an axis of said column.

16. A temporary column as claimed in claim 11, wherein said at least one diagonal brace and said at least one knee brace comprise cross sections with sufficient moments of inertia to resist both tension and compression forces.

17. A temporary column structure according to claim 11 comprising:

three additional columns; and three additional base assemblies each having a base plate having a surface area for receiving a vehicle tire rolled thereon, a receiving tube portion mounted fixedly to each said base plate, said receiving tube portion open at a top end for receiving one respective additional column therein, said receiving tube portion holding said one respective additional column in an upright orientation;

each column oriented for each base plate to accept one wheel of a four-wheeled vehicle rolled onto said surface area, such that the four wheels of said vehicle each press down upon one base plate, said four columns being thereby prevented from overturning by the weight of said vehicle;

a canopy structure providing a covered area over said vehicle;

said canopy structure connected to said columns forming a roof over said vehicle.

18. A shelter as claimed in claim 17, wherein at least one of said additional columns is laterally braced by at least one knee brace connecting said additional column to said base plate.

19. A temporary structure according to claim 11 further comprising:

a tent;

a first guy-wire segment connecting an elevated position of said column to an elevated portion of said tent erected adjacent to said column, said elevated position at a higher elevation than said elevated portion, said first guy-wire segment exerting an upward force on said elevated portion of the tent to help hold the tent upright.

20. A temporary column structure according to claim 19, wherein said base plate further comprises at least one guy-wire anchor; and said structure further comprises a second guy-wire segment extending from said anchor to said elevated position of said column.

21. A temporary column structure according to claim 19, wherein said structure further comprises at least one strut, said strut connecting said column at a lower position below said elevated portion to said elevated portion and said strut providing a pushing force from said column onto said elevated portion which balances the lateral pulling force caused by the first guy-wire segment.

22. A temporary column structure according to claim 19, wherein said structure further comprises:

an addition base assembly held against said surface under a second tire of the vehicle;

an additional column, said additional column held vertical by said additional base assembly;

an additional first guy-wire segment and an additional second guy-wire segment, said additional first guy-wire segment connecting an elevated position of said additional column to an elevated portion of a back end of said tent, and said additional second guy-wire segment connecting said elevated position of said additional column to said additional base assembly; and said first guy-wire segment connected to said column is connected to a front end of said tent.

23. A temporary column structure according to claim 11 further comprising a signaling device mounted at an elevated position on said column.

24. A temporary column structure according to claim 23, wherein said signaling device comprises a loud speaker.

25. A temporary column structure according to claim 11 further comprising a light mounted at an elevated position on said column.

* * * * *